US005977991A

United States Patent [19]

DeGoricija et al.

[11] Patent Number: 5,977,991

[45] **Date of Patent: *Nov. 2, 1999**

[54] FRAME BUFFER SYSTEM WITH NON-OVERLAPPING PIXEL BUFFER ACCESS VARIABLE INTERLEAVING, NIBBLE REPLICATION

[75] Inventors: Darko DeGoricija, San Jose; Michael Andrew Ekberg, Atherton; Alex Koltzoff, Sausalito; Charles Srethabhakti, San Jose, all of Calif.

[73] Assignee: Sun Microsystems, Inc., Mountain View, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/778,735

[22] Filed: Jan. 2, 1997

Related U.S. Application Data

[63] Continuation of application No. 08/262,136, Jun. 16, 1994, abandoned.

[51] Int. Cl.[6] ..... G09G 5/36

[52] U.S. Cl. ..... 345/507; 345/155

[58] Field of Search ..... 345/185, 1, 115, 345/200, 201, 145, 191, 155, 153, 507; 341/50

[56] References Cited

U.S. PATENT DOCUMENTS 5,047,760 9/1991 Trevett et al. ..... 345/508

FOREIGN PATENT DOCUMENTS 3-210593 9/1991 Japan ..... 345/155

*Primary Examiner*—Jeffery Brier

*Attorney, Agent, or Firm*—Blakely Sokoloff Taylor & Zafman

[57] ABSTRACT

A frame buffer system is disclosed that employs non overlapping serial enable signals to access pixel data values from sets of pixel buffers contained in each interleave of a multiple interleave frame buffer according to the attribute data in the frame buffer. The frame buffer system provides circuitry for varying the interleave factor between frame buffer accesses and the generation of corresponding video data. The frame buffer system also provides circuitry for expanding double buffered pixel data values into full addressing for color look-up.

18 Claims, 13 Drawing Sheets

| | 24 Bit Pixel | 12 Bit Buffer A Pixel | 12 Bit Buffer B Pixel |
|---|---|---|---|
| Upper Nibble | Nibble A | Nibble A | Nibble B |
| Lower Nibble | Nibble B | Nibble A | Nibble B |
| Color Look-Up Table Address | AB | AA | BB |

*Figure 11*

FRAME BUFFER SYSTEM WITH NON-OVERLAPPING PIXEL BUFFER ACCESS VARIABLE INTERLEAVING, NIBBLE REPLICATION

This is a continuation of application Ser. No. 08/262,136 filed Jun. 16, 1994, now abandoned.

BACKGROUND OF THE INVENTION

1. Field of the Invention

The present invention pertains to the field of computer graphics systems. More particularly, this invention relates to a frame buffer system with non overlapping pixel buffer access, variable interleaving, nibble replication and unaligned VRAM/DRAM memory access.

2. Art Background

Prior computer graphics systems typically include a graphics subsystem that receives graphics data from a host processor and renders images defined by the graphics data onto a display. A typical prior graphics subsystem comprises a rendering controller or rendering processor, a frame buffer, a frame buffer post processor, and a digital to analog converter (DAC).

The rendering controller in such a prior system usually receives the graphics data from the host processor over a system bus. The rendering controller generates a set of pixel data according to the graphics data from the host processor. The rendering controller then writes the pixel data into the frame buffer.

The frame buffer in such a system typically contains a set of video random access memories (VRAMs) that buffer the pixel data generated by the rendering controller. Prior high performance graphics subsystems usually implement frame buffers with multiple interleave factors. Such multiple interleave frame buffers improve pixel data throughput between the rendering controller and the VRAMs. A multiple interleaved frame buffer overcomes the input/output bandwidth limitations of conventional VRAMs.

In such a prior system, the frame buffer typically transfers the pixel data to the frame buffer post processor over a pixel bus. The frame buffer post processor typically generates video data corresponding to the pixel data by performing frame buffer post processing functions on the pixel data. The frame buffer post processing functions typically include color look-up table functions and cursor control functions.

The frame buffer post processor typically transfers the video data to the DAC over a video bus. The DAC then performs digital to analog conversion functions on the video data and generates a set of analog video signals for the display device. The analog video signals typically include the red, green, and blue video signals and video sync signals for generating a display on the display device.

Such a multiple interleave frame buffer usually transfers multiple pixel data values in parallel over the pixel bus to the frame buffer post processor. Such a parallel transfer of multiple pixel data values requires that the frame buffer post processor provide a large number of input/output pins to accommodate the parallel pixel data.

For example, a common prior multiple interleave frame buffer provides a five way interleave factor. Such a frame buffer transfers five pixel data values in parallel over the pixel bus. Each pixel data value transferred over the pixel bus typically comprises 32 bits for a high resolution display device. As a consequence, the frame buffer post processor must provide 5×32 input pins for accepting the pixel data over the pixel bus. Unfortunately, such a high number of input pins greatly increases the manufacturing cost of the frame buffer post processor.

Furthermore, such a multiple interleave frame buffer usually transfers video data for multiple pixels in parallel over the video bus to the DAC according to the interleave factor of the frame buffer. Such a parallel transfer of video data also increases the number of output pins (5×24) for the frame buffer post processor, thereby increasing frame buffer post processor manufacturing costs. Such increased manufacturing costs of the frame buffer post processor greatly increases the overall system computer graphics system cost.

In addition, prior computer graphics systems commonly provide a frame buffer that accommodates 24 bit values in either single buffered or double buffered mode. Each 24 bit value usually provides a 24 bit pixel data value in single buffered mode, or a pair of 12 bit double buffered pixel data values in double buffered mode. Each 24 bit pixel data value typically comprises an 8 bit red value, an 8 bit green value, and an 8 bit blue value. On the other hand, each 12 bit double buffered pixel data value comprises a 4 bit red value, a 4 bit green value, and a 4 bit blue value in a double buffered arrangement.

In such a system, the frame buffer post processor typically implements separate color look-up tables for 24 bit single buffered and the 12 bit double buffered modes. Such a prior system typically provides color look-up tables with 256 colors for the 24 bit buffer single buffered mode and color look-up tables with 16 colors for the 12 bit double buffered mode. Unfortunately, the additional color look-up tables for the 12 bit double buffer mode increases the cost of the frame buffer post processor. Such increased cost contributes to increased costs of the overall computer graphics system.

SUMMARY OF THE INVENTION

A frame buffer system is disclosed comprising a frame buffer having a plurality of interleaves. Each interleave comprises a first buffer, a second buffer, and an interleave pixel bus coupled to the first and second buffers. Each interleave further comprises an attribute buffer containing an active buffer flag that indicates whether the first buffer or the second buffer provides an active image for a display. The frame buffer system further comprises a frame buffer post processor that accesses the active buffer flag from each attribute buffer. The frame buffer post processor then accesses a pixel data value from the first buffer or the second buffer over the interleave pixel bus of each interleave using non overlapping serial enable signals according to the active buffer flag.

The interleaved pixel busses have an input interleave factor. The frame buffer post processor accesses the pixel data values from each interleave over the pixel bus according to the input interleave factor. The frame buffer post processor contains circuitry for varying the interleave factor. The frame buffer post processor generates a set of video data from the pixel data values, and transfers the video data over a video bus according to an output interleave factor.

Each interleave of the frame buffer comprises an image buffer and an attribute buffer containing a double buffer flag. The double buffer flag indicates whether the image buffer contains pixel data values each comprising a first number of bits or double buffered pixel data values each comprising a second number of bits. The first number of bits is greater than the second number of bits. The frame buffer post processor contains a color look-up table addressable according to the first number of bits. The frame buffer post processor accesses each attribute buffer and each image buffer of the frame buffer. The frame buffer post processor contains circuitry for expanding each double buffered pixel data value to the first number of bits for addressing the color look-up circuit according to the double buffer flag.

BRIEF DESCRIPTION OF THE DRAWINGS

FIG. 11 is a state diagram for the red value replicator circuit which shows the selected upper nibble, the selected lower nibble, and the resulting color look-up table address for a 24 bit pixel, a 12 bit buffer A pixel, and a 12 bit buffer B pixel;

DETAILED DESCRIPTION

Figure 1:
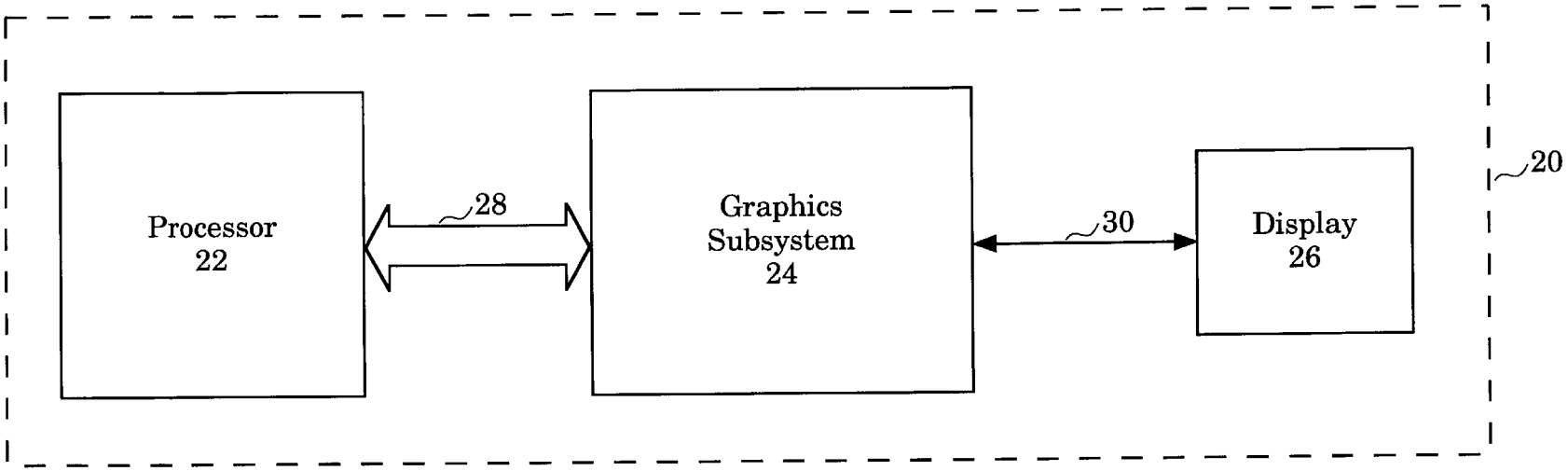
FIG. 1 illustrates a computer graphics system which comprises a processor, a graphics subsystem, and a display.

FIG. 1 illustrates a computer graphics system 20 for one embodiment. The computer graphics system 20 comprises a processor 22, a graphics subsystem 24, and a display 26. The processor 22 communicates with the graphics subsystem 24 over a system bus 28.

The processor 22 executes computer graphics application programs. The computer graphics application programs generate graphics data that define graphical elements for display on the display 26. The processor 22 transfers the graphics data to the graphics subsystem 24 over the system bus 28. The processor 22 also accesses graphics data from the graphics subsystem 24 over the system bus 28 for interactive computer graphics application programs.

The graphics subsystem 24 processes the graphics data received from the processor 22 and renders the corresponding graphical elements onto the display 26. The graphics subsystem 24 communicates with the display 26 over a set of video signal lines 30. The video signal lines 30 transfer the red, green and blue video signals and video sync signals for generating images on the display 26.

Figure 2:
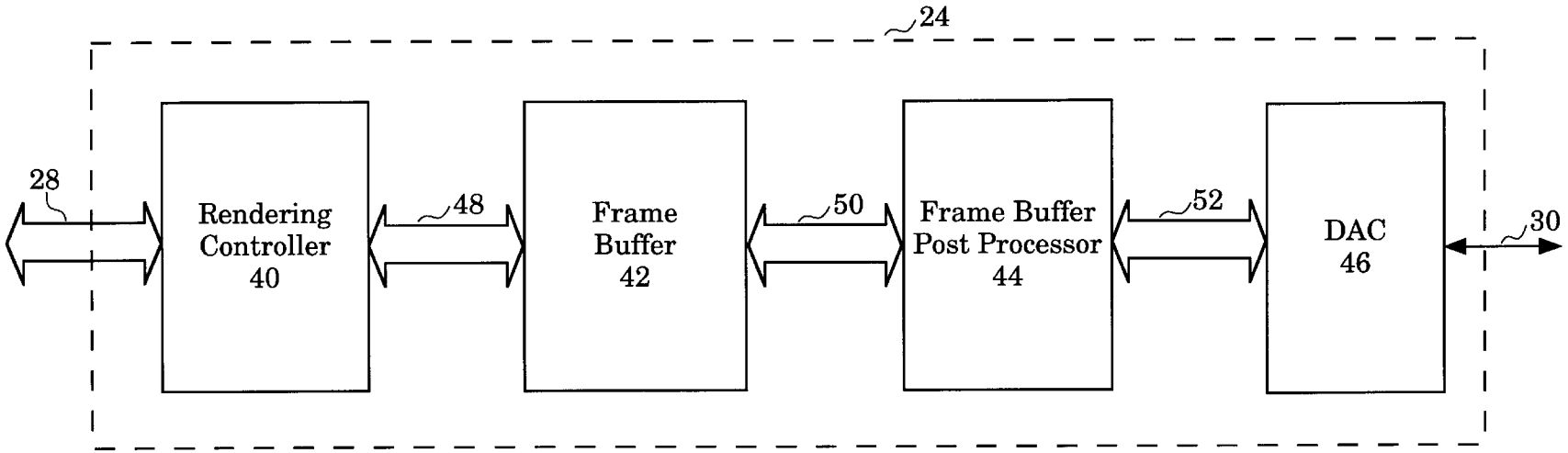
FIG. 2 illustrates the graphics subsystem for one embodiment which comprises a rendering controller, a frame buffer, a frame buffer post processor, and a digital to analog converter (DAC)

FIG. 2 illustrates the graphics subsystem 24 for one embodiment. The graphics subsystem 24 comprises a rendering controller 40, a frame buffer 42, a frame buffer post processor 44, a digital to analog converter (DAC) 46.

The rendering controller 40 receives graphics data from the processor 22 over the system bus 28. The rendering controller 40 generates digital pixel data values for rendering the graphical elements corresponding to the graphics data received from the processor 22. The rendering controller 40 transfers the digital pixel data values to the frame buffer 42 over a rendering bus 48.

The frame buffer 42 buffers digital pixel data values that define images for display on the display 26. For one embodiment the frame buffer 42 comprises a five way interleaved frame buffer. Each interleave of the frame buffer 42 comprises a 24 bit buffer A, a 24 bit buffer B, an 8 bit overlay buffer, and a 10 bit attribute buffer.

For an alternative embodiment, each interleave of the frame buffer 42 comprises a 24 bit buffer A, an 8 bit overlay buffer and a 10 bit attribute buffer. The 24 bit buffer A functions as either a 24 bit buffer for pixel data values or a 12 bit double buffer. The 12 bit double buffer provides a lower cost graphics frame buffer that does not employ the 24 bit buffer B for double buffering.

The frame buffer post processor 44 implements color look-up table functions and cursor control functions for the graphics subsystem 24. The frame buffer post processor 44 accesses the digital pixel data values from the frame buffer 42 over a pixel bus 50. The frame buffer post processor 44 generates a corresponding set of video data, and transfers the video data to the DAC 46 over a video bus 52.

For one embodiment, the pixel bus 50 enables concurrent transfer of digital pixel data values from the 5 interleaves of the frame buffer 42 over the pixel bus 50. The frame buffer post processor 44 controls the transfer of pixel data values over the pixel bus 50. The frame buffer post processor 44 generates a set of non-overlapping serial enable signals and shift clock signals on the pixel bus 50. The non-overlapping serial enable signals and shift clock signals select from among the 24 bit buffer A, the 24 bit buffer B, and the 8 bit overlay buffer from each interleave of the frame buffer 42.

The frame buffer post processor 44 varies the interleave factor between the pixel data values received over the pixel bus 50 and the corresponding video data transferred over the video bus 52. For one embodiment, the frame buffer post processor converts the 5 way interleave on the pixel bus 50 to a two way interleave internally. The frame buffer post processor 44 then performs color look-up table functions on the internal two way interleaved pixel data values and transfers a set of corresponding two way interleaved video data to the DAC 46 over the video bus 52.

The frame buffer post processor 44 performs nibble replication on pixel data values received over the pixel bus 50 from the 24 bit buffer A and each interleave of the frame buffer 42 according to the corresponding attribute data. The nibble replication function provided by the frame buffer post processor 44 enables the 24 bit buffer A of the frame buffer 42 to function as a 12 bit double buffer. The frame buffer post processor 44 performs 12 bit color look-up table operations for the 12 bit double buffer pixel data values provided by the internal nibble replication function.

The DAC 46 receives the two way interleaved video data from the frame buffer post processor 44 over the video bus 52. The DAC 46 converts the video data received from the frame buffer post processor 44 into a set of red, green, and blue analog video signals. The DAC 46 also generates a set of video sync signals. The DAC 46 transfers the red, green, and blue video signals as well as the video sync signals to the display 26 over the video signal lines 30.

For one embodiment, the pixel data values transferred over the pixel bus 50 from the frame buffer 42 to the frame buffer post processor 44 comprises a 5 way interleaved transfer at a frequency of 27 megahertz. The transfer of video data over the video bus 52 from the frame buffer post processor 44 to the DAC 46 comprises a two way interleaved video data transfer at 67.5 megahertz. The DAC 46 in turn transfers red, green, and blue video signals and video sync signals to the display 26 over the video signal lines 30 at a frequency of 135 megahertz.

Figure 3:
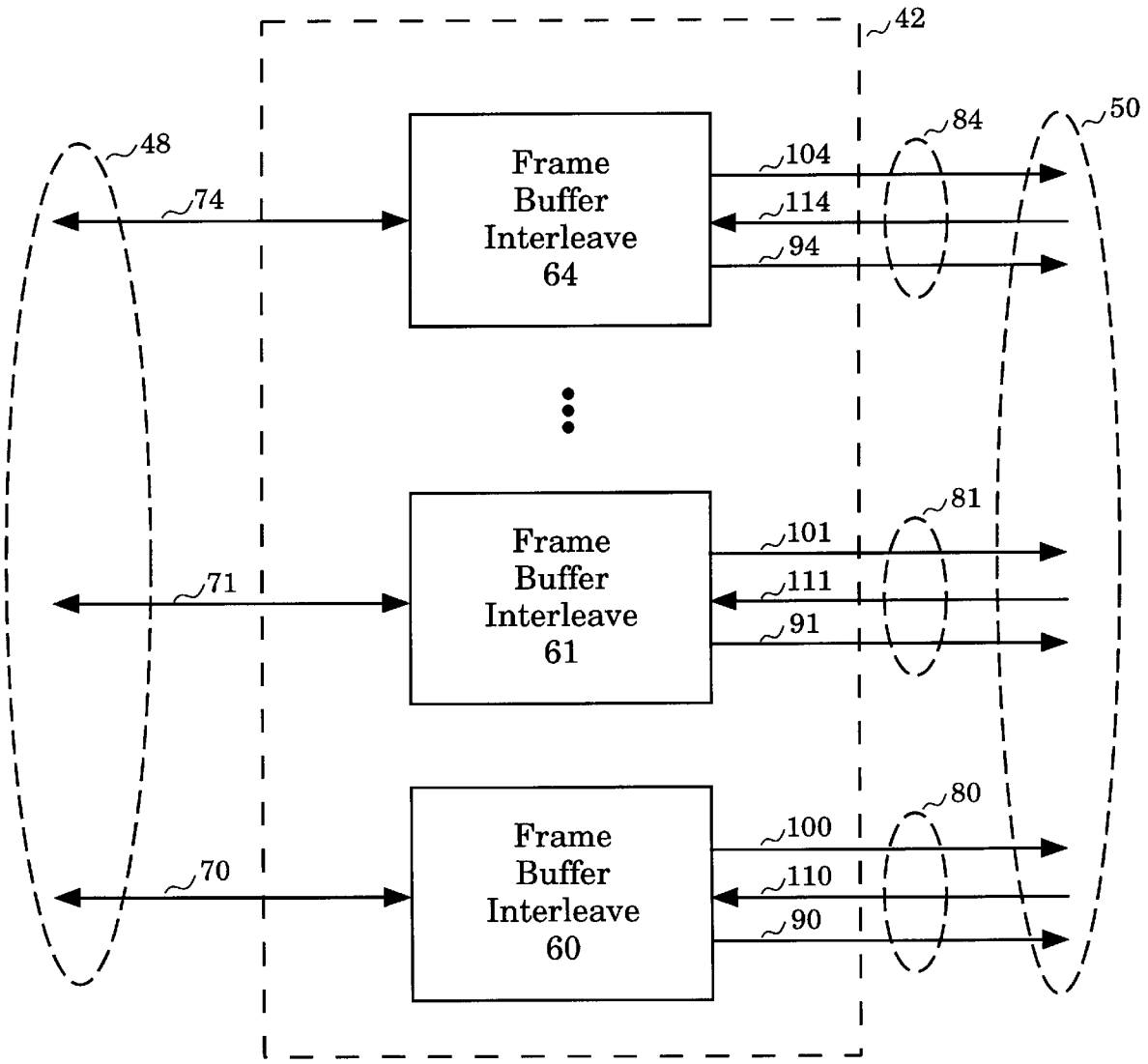
FIG. 3 illustrates the frame buffer for one embodiment which comprises a set of five frame buffer interleaves that receive digital pixel data values from the rendering controller over a corresponding set of five way interleaved rendering busses.

FIG. 3 illustrates the frame buffer 42 for one embodiment. The frame buffer 42 comprises a set of five frame buffer interleaves 60–64. The frame buffer interleaves 60–64 receive digital pixel data values from the rendering controller 40 over a corresponding set of five way interleaved rendering busses 70–74.

Each frame buffer interleave 60–64 contains a 24 bit buffer A interleave, a 24 bit buffer B interleave, an 8 bit overlay interleave, and a 10 bit attribute interleave. For one embodiment, the 24 bit buffer A interleave, a 24 bit buffer B interleave, an 8 bit overlay interleave of the frame buffer interleaves 60–64 each provide a frame buffer for a 1280× 1024 raster display on the display 26.

The frame buffer post processor 44 accesses the frame buffer interleaves 60–64 over a set of interleaved pixel busses 80–84. Each interleaved pixel bus 80–84 comprises an image bus, an attribute bus, and a set of frame buffer access signals. For example, the frame buffer interleave 60 transfers pixel data values from the corresponding 24 bit buffer A, 24 bit buffer B, and the 8 bit overlay buffer interleaves to the frame buffer post processor 44 over an image bus 100. In addition, the frame buffer interleave 60 transfers attribute data from the corresponding attribute buffer to the frame buffer post processor 44 over an attribute bus 90.

The frame buffer post processor 44 generates a set of frame buffer access signals 110 for accessing the frame buffer interleave 60. The frame buffer access signals 110 include serial enable signals for the buffer A interleave, the buffer B interleave, and the overlay buffer interleave. The serial enable signals of the access signals 110 select either the buffer A interleave, the buffer B interleave or the overlay buffer interleave in the frame buffer interleave 60 to transfer pixel data values over the image bus 100.

The frame buffer access signals 110 also include shift-clock signals. The shift clock signals of the frame buffer access signals 110 include a shift clock signal for the attribute buffer, and a shift clock signal for the buffer A interleave, the buffer B interleave, and the overlay buffer interleave. The shift clock signals of the frame buffer access signals 110 synchronize data transfers over the attribute bus 90 and the image bus 100.

Similarly, the frame buffer interleave 61 transfers pixel data values from the corresponding buffer A, buffer B, and the overlay buffer interleaves to the frame buffer post processor 44 over an image bus 101. The frame buffer interleave 61 transfers attribute data to the frame buffer post processor 44 over an attribute bus 91. The frame buffer interleave 61 receives a set of frame buffer access signals 111 from the frame buffer post processor 44 that control the transfer of pixel data values over the image bus 101 and the transfer of attribute data values over an attribute bus 91.

The frame buffer interleave 64 receives a set of frame buffer access signals 114 from the frame buffer post processor 44. The frame buffer access signals 114 select among the corresponding buffer A, buffer B, and overlay buffer interleaves for transfer of pixel data values over an image bus 104. The frame buffer access signals 114 also control the transfer of attribute data values from the corresponding attribute buffer over an attribute bus 94.

Figure 4:
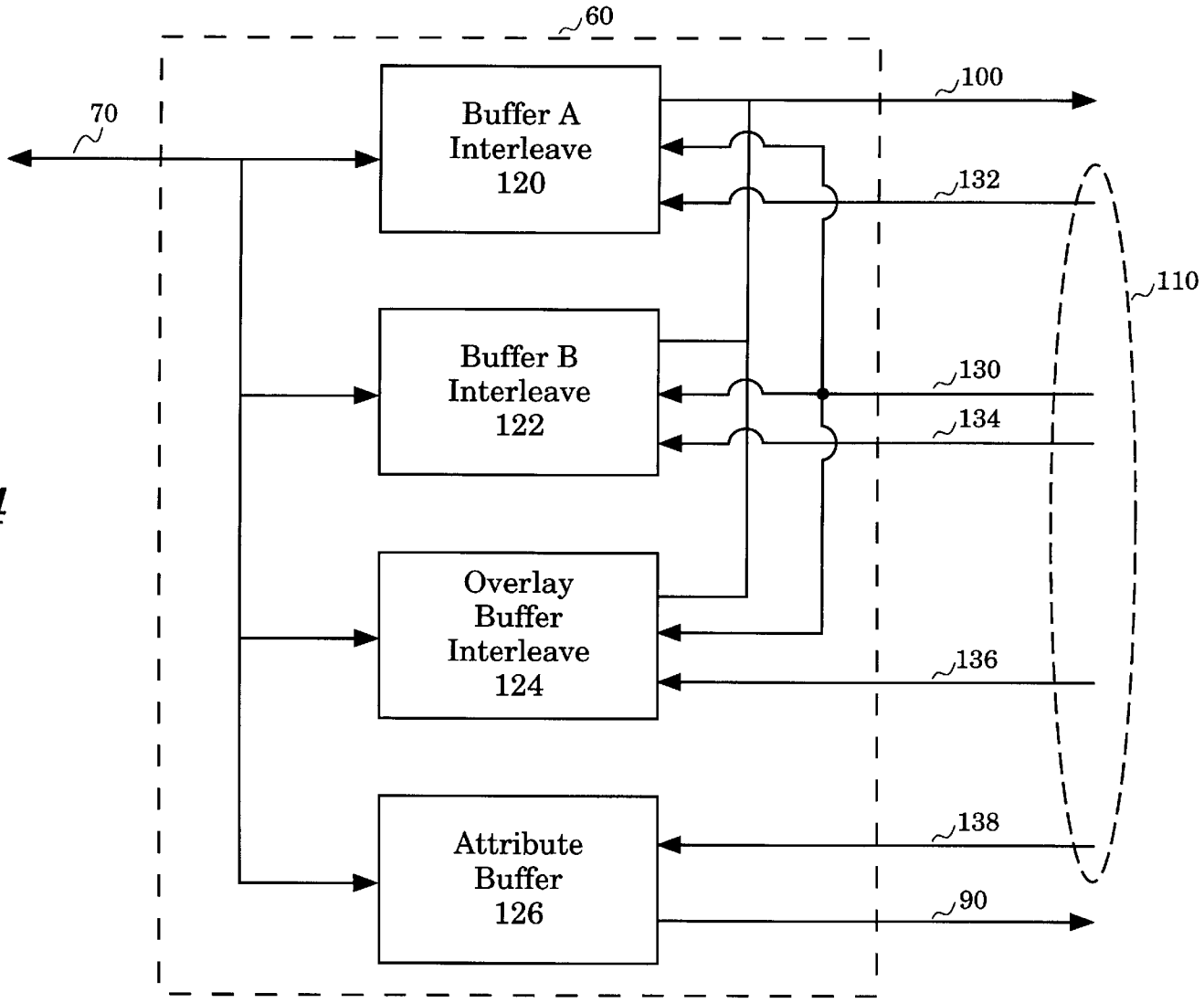
FIG. 4 is a diagram illustrating a frame buffer interleave for one embodiment which comprises a buffer A interleave, a buffer B interleave, an overlay buffer interleave, and an attribute buffer.

FIG. 4 illustrates a frame buffer interleave 60 for one embodiment. The frame buffer interleave 61–64 are substantially similar to the frame buffer interleave 60. The frame buffer interleave 60 comprises a buffer A interleave 120, a buffer B interleave 122, an overlay buffer interleave 124, and an attribute buffer 126.

For one embodiment, the buffer A interleave 120 and the buffer B interleave 122 each comprise a 24 bit frame buffer interleave. The overlay buffer interleave 124 comprises an 8 bit overlay frame buffer interleave. The attribute buffer 126 comprises a 10 bit attribute buffer.

The attribute buffer 126 buffers a set of attributes for the pixel data values stored in the buffer A interleave 120, the buffer B interleave 122, and the overlay buffer interleave 124. The rendering controller 40 writes active image attribute bits into the attribute buffer 126 to select an active image for the display 26. The active image for the display 26 is defined by pixel data pixel data values from the buffer A interleave 120 or by pixel data values from the buffer B interleave 122 or by pixel data values from the overlay buffer interleave 124 according to the corresponding attributes.

The attributes in the attribute buffer 126 also indicate whether the buffer A interleave 120 contains 24 bit pixel data values or a 12 bit double buffered pixel data values. The rendering controller 40 writes the attributes in the attribute buffer 126 to select either the 24 bit buffer mode or the 12 bit double buffered mode for the buffer A interleave 120.

The frame buffer post processor 44 generates an attribute shift clock 138 to synchronize the transfer of attribute data from the attribute buffer 126 over the attribute bus 90. The frame buffer post processor 44 uses the attribute data received over the attribute bus 90 to determine a source for the active image from among the buffer A interleave 120, the buffer B interleave 122, and the overlay buffer interleave 124.

The frame buffer post processor 44 then generates a set of serial enable signals, illustrated in FIG. 4 as 132, 134, and 136, to enable either the buffer A interleave 120, the buffer B interleave 122, and the overlay buffer interleave 124 to drive the image bus 100 according to the corresponding attribute data. The frame buffer post processor 44 also generates an image shift clock 130 to synchronize transfer of the pixel data values over the image bus 100.

The serial enable signal 136 enables and disables the transfer of pixel data by the overlay buffer interleave 124 over the image bus 100. The serial enable signal 134 enables and disables the transfer of pixel data from the buffer B interleave 122 over the image bus 100, and the serial enable signal 132 enables and disables the transfer of pixel data from the buffer A interleave 120 over the image bus 100. The image shift clock 130 synchronizes the transfer of pixel data from either the buffer A interleave 120, the buffer B interleave 122, or the overlay buffer interleave 124 over the image bus 100 to the frame buffer post processor 44.

Figure 5:
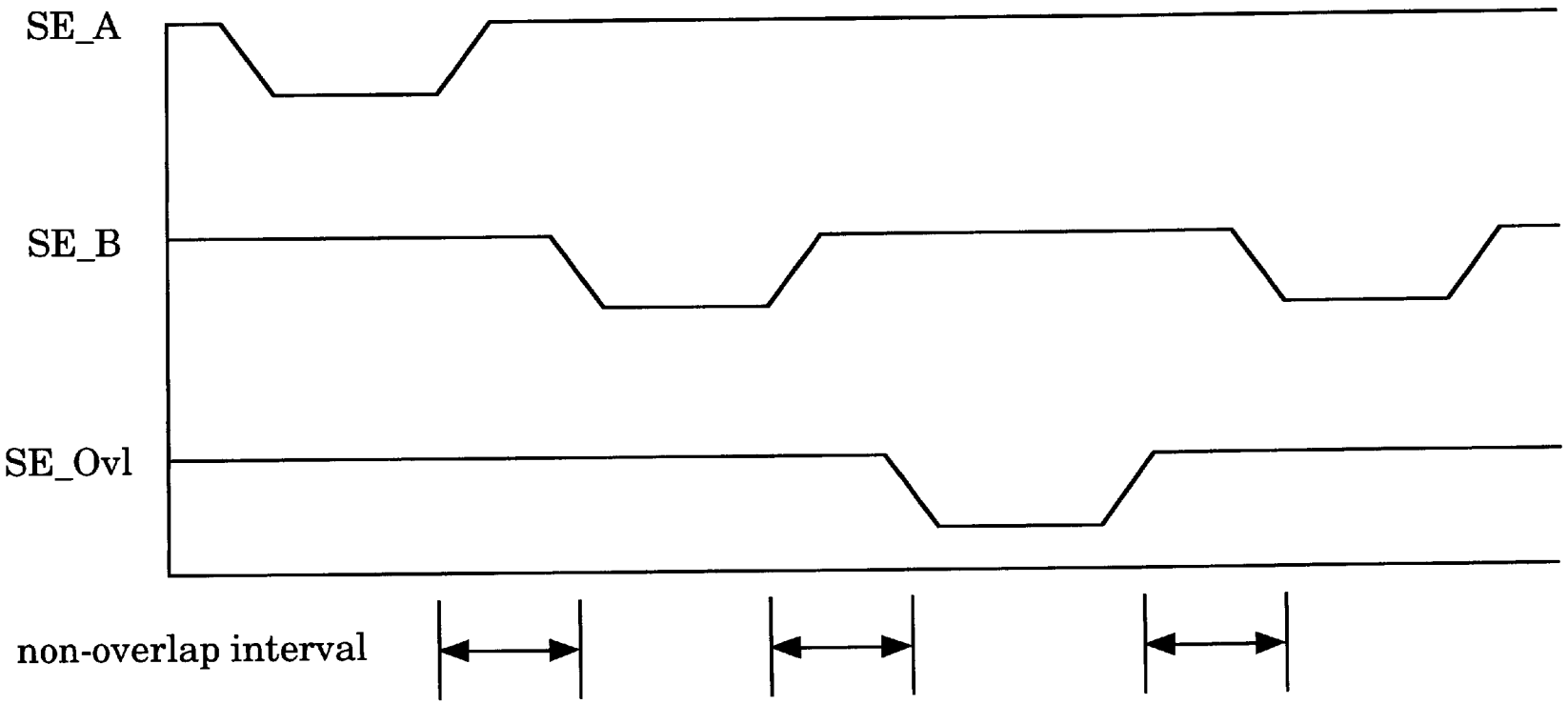
FIG. 5 illustrates the serial enable signals that enable transfer of pixel data values from the buffer A interleave, the buffer B interleave, and the overlay buffer interleave.

FIG. 5 illustrates the serial enable signals 132, 134, and 136 for one embodiment. The frame buffer post processor 44 generates the serial enable signal 132 (SE_A) to read pixel data values from the buffer A interleave 120. The frame buffer post processor 44 generates the serial enable signal 134 (SE_B) to read pixel data values from the buffer B interleave 122. The frame buffer post processor 44 generates the serial enable signal 136 (SE_OVL) to read pixel data values from the overlay buffer interleave 124.

The frame buffer post processor 44 generates the serial enable signals 132–136 to provide the non-overlap regions as shown. The non-overlap regions of the serial enable signals 132, 134, and 136 ensure that the "on" times of the buffer A interleave 120, the buffer B interleave 122, and the overlay buffer interleave 124 do not overlap. The non-overlapping serial enable signals 132, 134, and 136 allow the buffer A interleave 120, the buffer B interleave 122, and the overlay buffer interleave 124 to share the image bus 100 for pixel data transfers to the frame buffer post processor 44.

For one embodiment, the image bus 100 comprises 24 bits. The duration of the non-overlap regions comprise one pixel transfer interval on the image bus 100. The non-overlap intervals of the serial enable signals 132, 134, and 136 allow time for previously active drivers in the buffer A interleave 120, the buffer B interleave 122, and the overlay buffer interleave 124 to completely shut off before the subsequently enabled drivers become active on the image bus 100.

Figure 6:
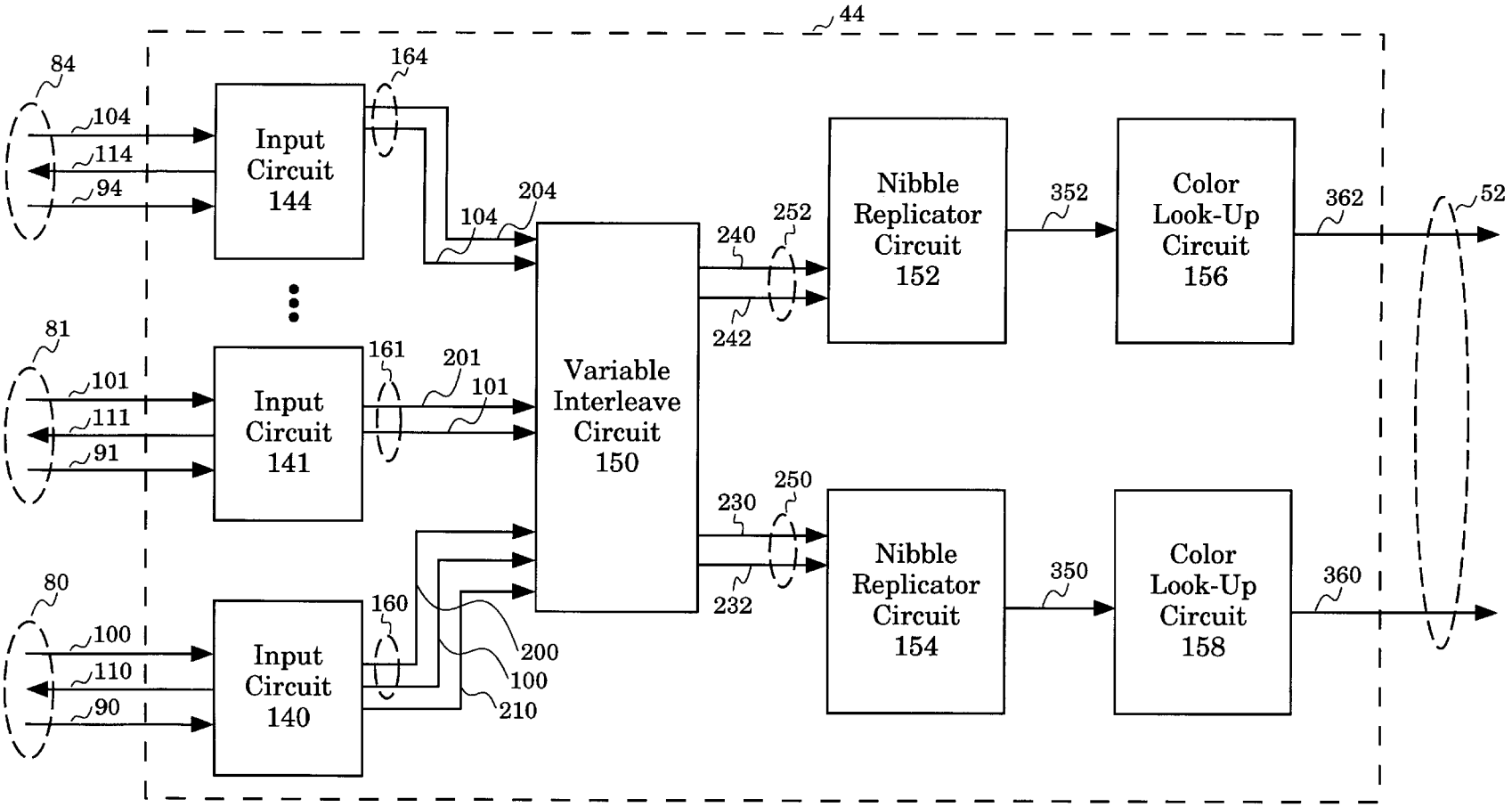
FIG. 6 illustrates the frame buffer post processor for one embodiment which comprises a set of input circuits, a variable interleave circuit, a pair of nibble replicator circuits, and a pair of color look-up circuits.

FIG. 6 illustrates the frame buffer post processor 44 for one embodiment. The frame buffer post processor 44 comprises a set of input circuits 140–144, a variable interleave circuit 150, a pair of nibble replicator circuits 152 and 154, and a pair of color look-up circuits 156 and 158. The nibble replicator circuit 152 is substantially similar to the nibble replicator circuit 154. The color look-up circuit 156 is substantially similar to the color look-up circuit 158.

The input circuits 140–144 access pixel data from the frame buffer interleaves 60–64 in the frame buffer 42. The input circuits 140–144 generate the sets of frame buffer access signals 110–114. The frame buffer access signals 110–114 initially cause the frame buffer interleaves 60–64 to transfer attribute data over the attribute busses 90–94.

The input circuits 140–144 receive the attribute data over the attribute busses 90–94, determine whether the buffer A, the buffer B, or the overlay buffer in the frame buffer interleaves 60–64 is selected for display on the display 26. The input circuits 140–144 accordingly generate the frame buffer access signals 110–114 to read the buffer A, the buffer B, or the overlay buffer pixel data from the frame buffer interleaves 60–64 over the image busses 100–104.

The input circuits 140–144 transfer 5 way interleave data 160–164 to the variable interleave circuit 150. Each set of interleaved data 160–164 comprises image data, attribute data, and control information for the corresponding interleave of the frame buffer 42.

For example, interleaved data 160 comprises pixel data values on an image data bus 100, corresponding attribute data on an attribute data bus 200, and image control information on a control bus 210. Similarly, the interleave data 161 comprises pixel data values on an image data bus 101, corresponding attribute data on an attribute data bus 201, and image control information on a control bus 211. The interleave data 164 comprises an image data bus 104, an attribute data bus 204, and a control bus 214.

The variable interleave circuit 150 converts the 5 way interleave data 160–164 to a set of 2 way interleave data 250 and 252. The interleave data 250 comprises pixel data values on an image bus 230 and corresponding attribute data on an attribute bus 232. The interleave data 252 comprises pixel data values an image bus 240 and corresponding attribute data an attribute bus 242.

The nibble replicator circuit 152 receives the pixel data values over the image bus 240, and performs nibble replication on the pixel data values according to the attribute data on the attribute bus 242. The nibble replicator circuit 152 then transfers the resulting pixel data values to the color look-up circuit 156 over a pixel bus 352.

Similarly, the nibble replicator circuit 154 performs nibble replication on pixel data values received over the image bus 230 according to the attribute data received over the attribute bus 232. The nibble replicator circuit 154 then transfers resulting pixel data to the color look-up circuit 158 over the pixel bus 350.

The color look-up circuit 156 receives the pixel data values on the pixel bus 352, and performs color look-up functions on the pixel data values. The color look-up circuit 156 generates video data according to the color look-up functions, and transfers the video data to the DAC 46 over a video bus 362.

Similarly, the color look-up circuit 158 receives the pixel data values on the pixel bus 350, and generates video data by performing color look-up functions on pixel data values. The color look-up circuit 158 transfers the video data to the DAC 46 over a video bus 360.

Figure 7:
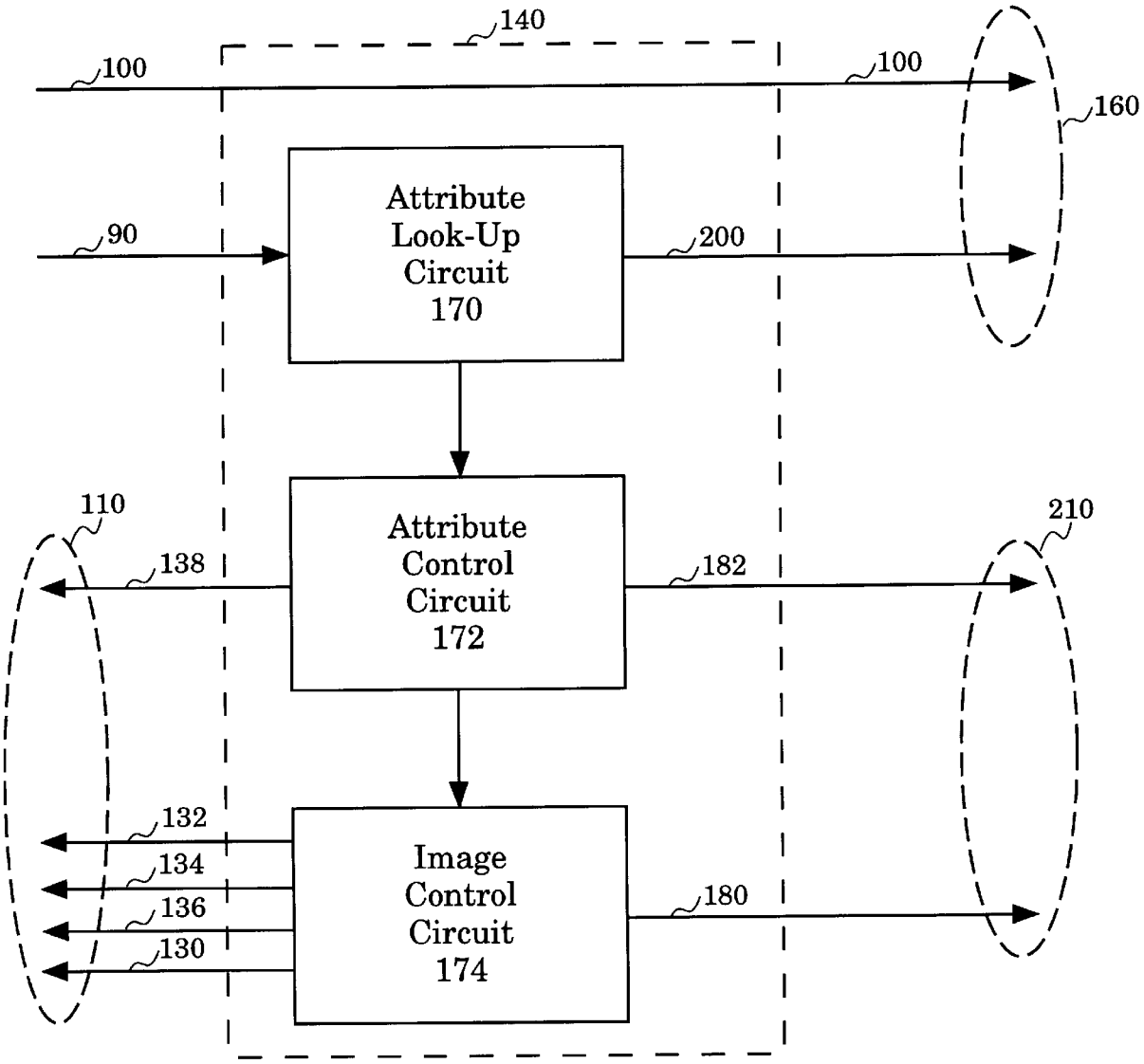
FIG. 7 illustrates the input circuit for one embodiment which comprises an attribute look-up circuit, an attribute control circuit, and an image control circuit.

FIG. 7 illustrates the input circuit 140 for one embodiment. The input circuits 141–144 are substantially similar to the input circuit 140. The input circuit 140 comprises an attribute look-up circuit 170, an attribute control circuit 172, and an image control circuit 174.

The attribute control circuit 172 generates the attribute shift clock 138 for the frame buffer interleave 60. The attribute shift clock 138 causes the attribute buffer 126 to transfer attribute data over the attribute bus 90. The attribute control circuit 172 also generates image control signals 182 for the variable interleave circuit 150. The image control signals 182 control the loading of registers in the variable interleave circuit 150 that buffer attribute data for 5 to 2 interleave conversion on the attribute data.

The attribute look-up circuit 170 receives the attribute data over the attribute bus 90 and performs look-up table functions on the attribute data. The attribute look-up circuit 170 then transfers the resulting attribute data to the variable interleave circuit 150 over the attribute bus 200.

The attribute control circuit 172 causes the image control circuit 174 to generate the serial enable signals 132, 134, and 136 and the image shift clock 130. The serial enable signals 132, 134, and 136 select the buffer A interleave 120, the buffer B interleave 122, or the overlay buffer interleave 124 in the frame buffer interleave 60 to drive the image bus 100. The image shift clock 130 synchronizes the pixel data values on the image bus 100. The attribute control circuit 172 also generates attribute control signals 180 for the variable interleave circuit 150. The attribute control signals 180 control the loading of registers in the variable interleave circuit 150 that buffer pixel data values for 5 to 2 interleave conversion of the pixel data values.

Figure 8:
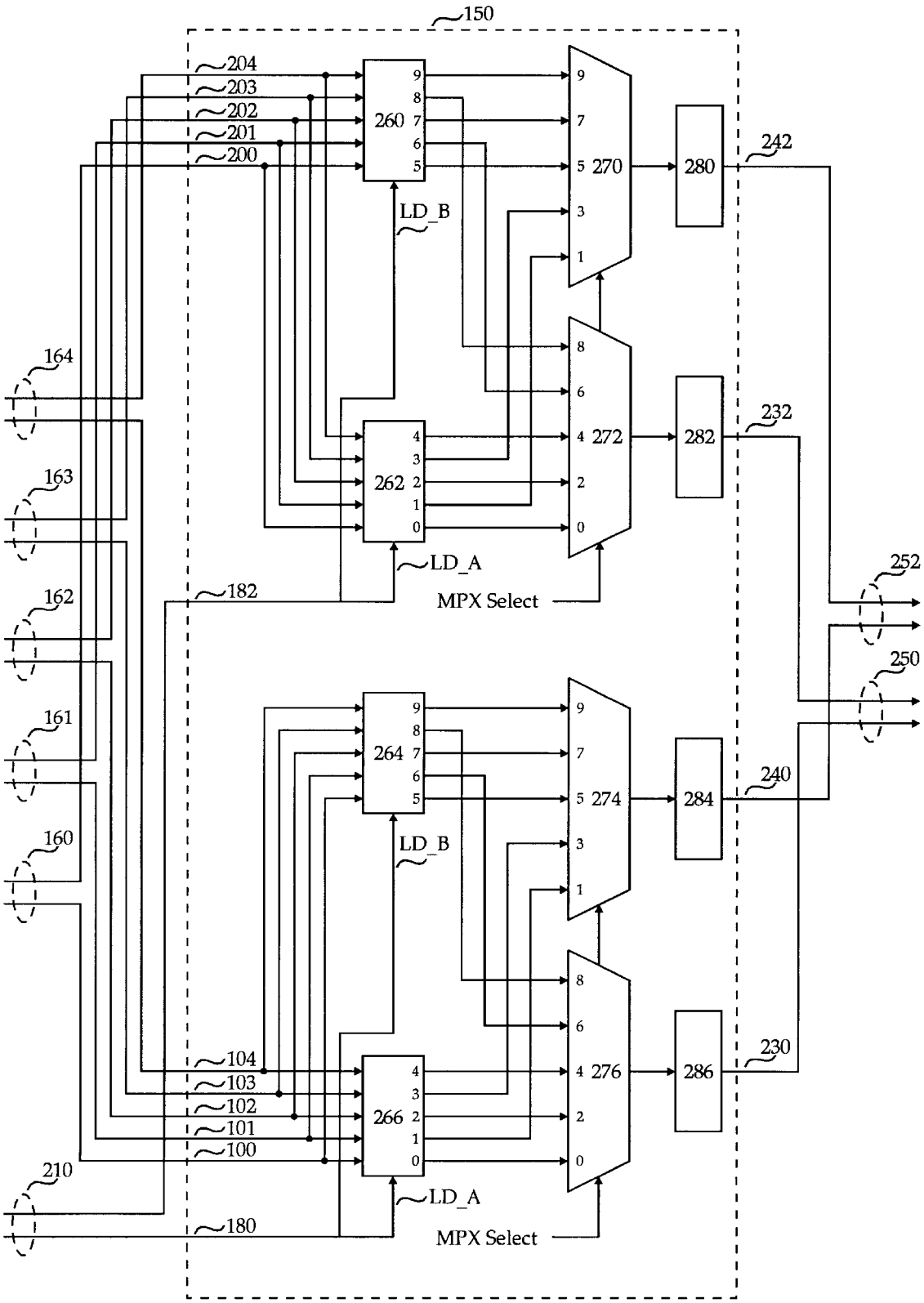
FIG. 8 is a diagram illustrating the variable interleave circuit for one embodiment which converts the 5 way interleave pixel data into the 2 way interleave pixel data.

FIG. 8 illustrates the variable interleave circuit 150 for one embodiment. The variable interleave circuit 150 comprises a set of multiplexers 270, 272, 274, and 276 that convert the 5 way interleave data 160–164 into the 2 way interleave data 250 and 252. The variable interleave circuit 150 further comprises a set of registers 260, 262, 264, and 266.

Each of the registers 260, 262, 264, and 266 latches a set of five pixels and attributes data. The registers 260 and 262 are each coupled to receive 5 way interleaved attribute data over the attribute data busses 200–204 from the input circuits 140–144. The registers 264 and 266 are each coupled to receive 5 way interleaved pixel data values from the input circuits 140–144 over the image busses 100–104.

The registers 260 and 262 are loaded under control of the attribute control signals received from the attribute control circuits in the input circuits 140–144 over the control buses 210–214. The registers 260 and 262 taken together provide attributes for a set of 10 sequentially received pixels to the multiplexers 270 and 272.

The multiplexers 270 and 272 each select one of the 5 corresponding attributes from the registers 260 and 262. The multiplexers 270 and 272 are controlled by the image control signals received over the control buses 210–214. The attribute data selected by the multiplexers 270 and 272 is latched in a pair of registers 280 and 282. The registers 280 and 282 provide 2 way interleaved attribute data for transfer over the attribute buses 242 and 232, respectively.

The registers 264 and 266 are loaded under control of the image control signals received from the image control circuits in the input circuits 140–144 over the control busses 210–214. The register 264 and 266 together provide pixel data for a set of 10 pixels sequentially received over the image data buses 100–104.

The multiplexers 274 and 276 each select one of the corresponding 5 pixels from the registers 264 and 266. The multiplexers 274 and 276 are controlled by the image control signals received over the control buses 210–214. The selected outputs of the multiplexers 274 and 276 are latched in a pair of registers 284 and 286. The registers 284 and 286 provide 2 way interleaved pixel data values for transfer over the image buses 240 and 230, respectively.

Figure 9:
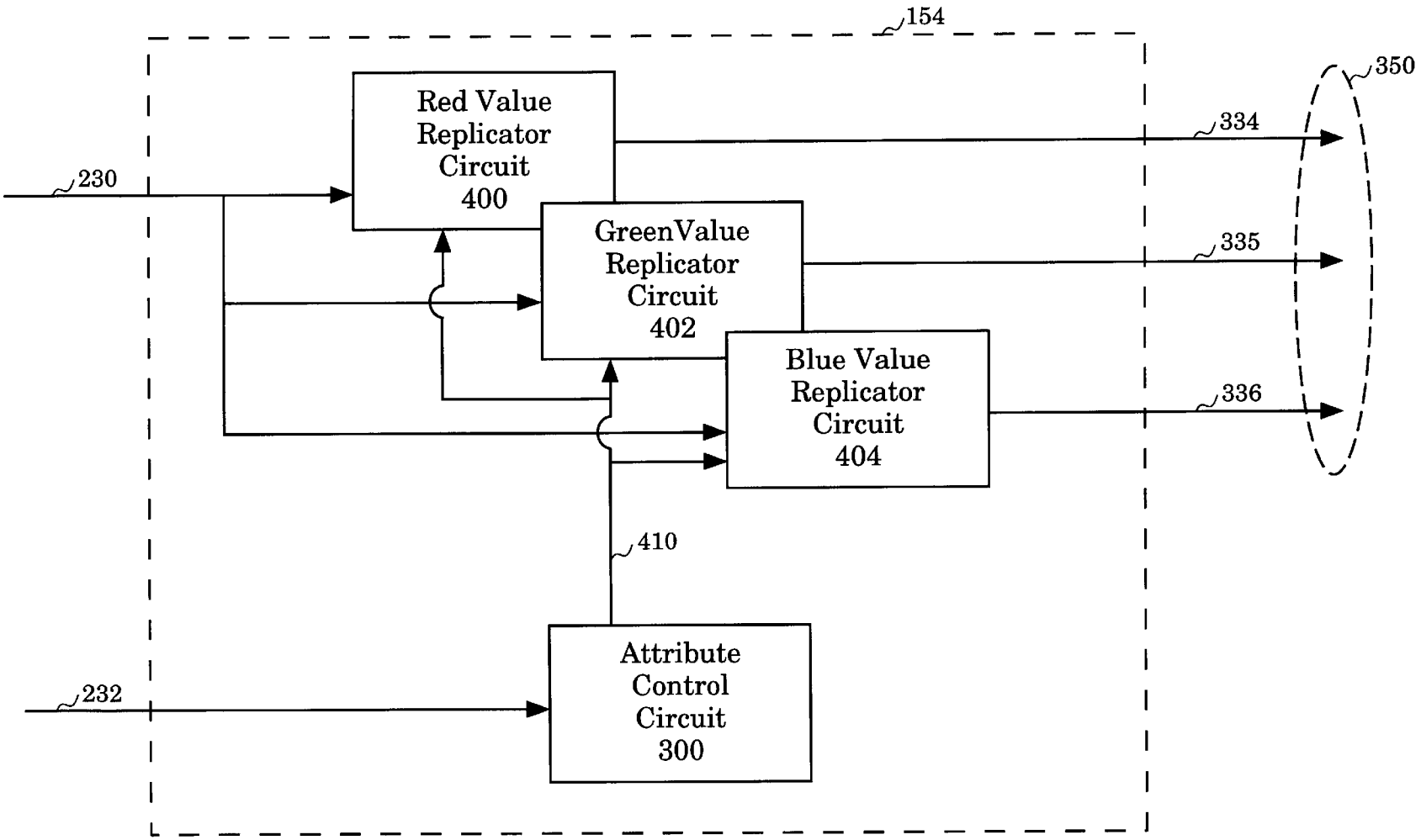
FIG. 9 is a diagram illustrating a nibble replicator circuit for one embodiment which comprises a set of red, green, and blue value replicator circuits, and an attribute control circuit.

FIG. 9 illustrates the nibble replicator circuit 154 for one embodiment. The nibble replicator circuit 152 is substantially similar to the nibble replicator circuit 154. The nibble replicator circuit 154 comprises a set of red, green, and blue value replicator circuits, illustrated in FIG. 9 as 400, 402, and 404 and an attribute control circuit 300.

The red, green, and blue value replicator circuits 400, 402, and 404 receive pixel data values over the image bus 230 from the variable interleave circuit 150. The pixel data values on the image bus 230 each comprise a red value, a green value, and a blue value. The red value replicator circuit 400 performs nibble replication on the red values, the green value replicator circuit 402 performs nibble replication on the green values, and the blue value replicator circuit 404 performs nibble replication on the blue values received over the image bus 230.

The attribute control circuit 300 receives attribute data over the attribute bus 232 from the variable interleave circuit 150. The attribute data on the attribute bus 232 corresponds to the pixel data values on the image bus 230. The attribute data on the attribute data bus 232 indicates whether the pixel data values received over the image bus 230 comprise 24 bit pixel data values or 12 bit double buffered pixel data values. The attribute control circuit 300 generates a set of control signals 410 according to the attribute data received over the attribute bus 232. The control signals 410 control the nibble replication functions of the red, green, and blue value replicator circuits 400, 402, and 404.

The red value replicator circuit 400 generates a red color look-up table address 334. The green value replicator circuit 402 generates a green color look-up table address 335, and the blue value replicator circuit 404 generates a blue color look-up table address 336. The color look-up table addresses 334–336 are transferred to the color look-up circuit 158 over the pixel bus 350. The red, green, and blue value replicator circuits 400–404 each provide a full 8 bit address to the color look-up circuit 158 for 24 bit pixel data values or 12 bit double buffered pixel data values received over the image bus 230.

Figure 10:
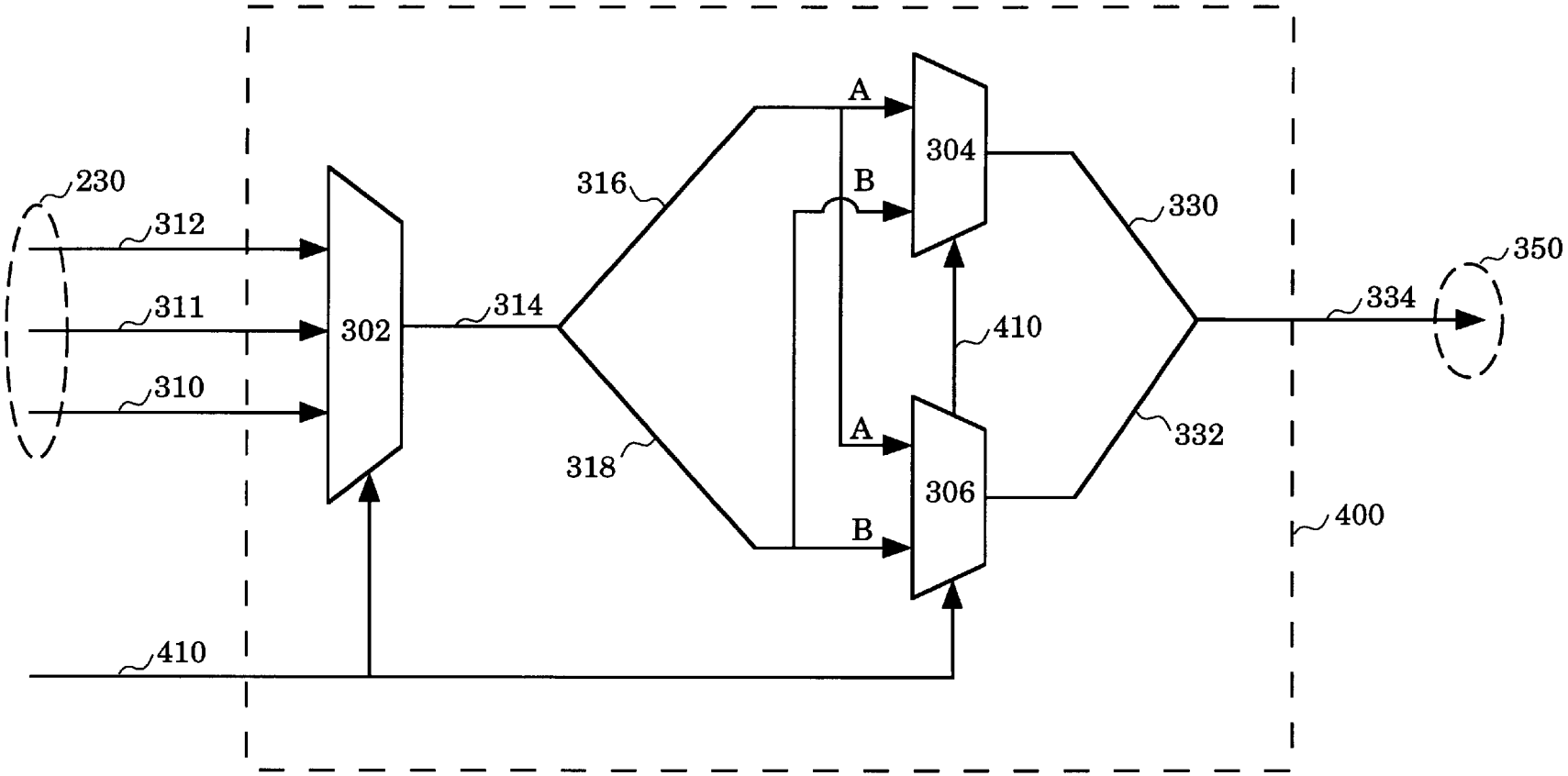
FIG. 10 is a diagram illustrating the red value replicator circuit for one embodiment.

FIG. 10 illustrates the red value replicator circuit 400 for one embodiment. The green and blue value replicator circuits 402 and 404 are each substantially similar to the red value replicator circuit 400. The red value replicator circuit 400 comprises a set of multiplexers, illustrate in FIG. 10 as 302, 304, 306.

The multiplexer 302 receives pixel value data values over the image bus 230 from the variable interleave circuit 150. The pixel data values on the image bus 230 each comprise a red value 310, a green value 311, and a blue value 312. The multiplexer 302 selects the red value 310 for a color value 314 under control of the control signals 410 generated by the attribute control circuit 300.

The color value 314 comprises 8 bits including an upper 4 bit nibble 316 and a lower 4 bit nibble 318. For a 12 bit double buffered pixel data value on the image bus 230, the upper nibble 316 corresponds to a buffer A nibble, and the lower nibble 318 corresponds to a buffer B nibble. The red value replicator circuit 400 expands the buffer A and buffer B nibbles into full 8 bit addresses under control of the control signals 410.

The multiplexer 304 selects the buffer A nibble 316 or the buffer B nibble 318 according to the control signals 410. The multiplexer 306 also selects the buffer A or the buffer B nibbles according to the control signals 410. A selected upper nibble 330 from the multiplexer 304 is merged with a selected lower nibble 332 from the multiplexer 306 to provide the color look-up table address 334.

The color look-up table address 334 is transferred to the color look-up circuit 158 over the pixel bus 350. The color look-up table address 334 provides a full 8 bit address to a red color look-up table in the color look-up circuit 158. The expansion of the 4 bit buffer A nibble 316 and the 4 bit buffer B nibble 318 into the 8 bit color look-up table address 334 enables a single 24 bit color look-up table to be used for both 24 bit pixel data values and 12 bit double buffered pixel data values.

Table 1 illustrates the expansion of the 4 bit buffer A nibble 316 and the 4 bit buffer B nibble 318 into the 8 bit color look-up table address 334. The red value replicator circuit 400 provides mapping of 4 bit nibbles to 16 colors while covering the full range of the 8 bit address space the red color look-up table in the color look-up circuit 158. The distance between any two colors for a 12 bit double buffered nibble is a constant equal to 17.

TABLE 1

| Expansion of nibble to full 8 bit address | | | |
|---|---|---|---|
| Index | 4 Bit Buffer | 8 Bit Address | Decimal |
| | 3210 | 7654 3210 | |
| 0 | 0000 | 0000 0000 | 0 |
| 1 | 0001 | 0001 0001 | 17 |
| 2 | 0010 | 0010 0010 | 34 |
| 3 | 0011 | 0011 0011 | 51 |
| 4 | 0100 | 0100 0100 | 68 |
| 5 | 0101 | 0101 0101 | 85 |
| 6 | 0110 | 0110 0110 | 102 |
| 7 | 0111 | 0111 0111 | 119 |
| 8 | 1000 | 1000 1000 | 136 |
| 9 | 1001 | 1001 1001 | 153 |
| 10 | 1010 | 1010 1010 | 170 |
| 11 | 1011 | 1011 1011 | 187 |
| 12 | 1100 | 1100 1100 | 204 |
| 13 | 1101 | 1101 1101 | 221 |
| 14 | 1110 | 1110 1110 | 238 |
| 15 | 1111 | 1111 1111 | 255 |

FIG. 11 is a state diagram for the red value replicator circuit 400. The state diagram shows the selected upper nibble 330, the selected lower nibble 332, and the resulting color look-up table address 334 for a 24 bit pixel, a 12 bit buffer A pixel, and a 12 bit buffer B pixel.

For an alternative embodiment, the selected nibbles in 12 bit double buffered mode are padded with a constant 4 bits=to 0. However, the alternative embodiment limits the color range from 0-F0 hexadecimal.

The nibble replication described above may be extended to any depth of double buffering up to full double buffered 24 bit buffers. For example, the above replication method may be employed for 15 bit double buffering in a system that employs a 32 bit depth frame buffer. In 15 bit double buffer mode each color component comprises 5 bits. Three bits of extension are used to extend the 5 bits up to a full 8 bit address.

Table 2 shows the three extension bits in the 15 bit double buffer mode. The three extension bits are the most significant 3 bits of the 5 bit color data. The three extension bits illustrated as "rrr" correspond to bits 4—2. The "rrr" bits are replicated to create a full 8 bit color look-up address.

TABLE 2

| 5 bit buffer | 8 bit address |
|---|---|
| 43210 | 76543 210 |
| 00110 | 00110 001 |
| r rr = | rrr |

Table 3 shows a full list of 32 cases for 15 bit double buffering. The distance between any two colors varies between 8 and 9.

TABLE 3

| 15 bit Double Buffer Expansion | | | | |
|---|---|---|---|---|
| Index | 5 Bit Buffer | 8 Bit Address | Decimal | Distance |
| 0 | 00000 | 00000 000 | 0 | |
| 1 | 00001 | 00001 000 | 8 | 8 |
| 2 | 00010 | 00010 000 | 16 | 8 |
| 3 | 00011 | 00011 000 | 24 | 8 |
| 4 | 00100 | 00100 001 | 33 | 9 |
| 5 | 00101 | 00101 001 | 41 | 8 |
| 6 | 00110 | 00110 001 | 49 | 8 |
| 7 | 00111 | 00111 001 | 57 | 8 |
| 8 | 01000 | 01000 010 | 66 | 9 |
| 9 | 01001 | 01001 010 | 74 | 8 |
| 10 | 01010 | 01010 010 | 82 | 8 |
| 11 | 01011 | 01011 010 | 90 | 8 |
| 12 | 01100 | 01100 011 | 99 | 9 |
| 13 | 01101 | 01101 011 | 107 | 8 |
| 14 | 01110 | 01110 011 | 115 | 8 |
| 15 | 01111 | 01111 011 | 123 | 8 |
| 16 | 10000 | 10000 100 | 132 | 9 |
| 17 | 10001 | 10001 100 | 140 | 8 |
| 18 | 10010 | 10010 100 | 148 | 8 |
| 19 | 10011 | 10011 100 | 156 | 8 |
| 20 | 10100 | 10100 101 | 165 | 9 |
| 21 | 10101 | 10101 101 | 173 | 8 |
| 22 | 10110 | 10110 101 | 181 | 8 |
| 23 | 10111 | 10111 101 | 189 | 8 |
| 24 | 11000 | 11000 110 | 198 | 9 |
| 25 | 11001 | 11001 110 | 206 | 8 |
| 26 | 11010 | 11010 110 | 214 | 8 |
| 27 | 11011 | 11011 110 | 222 | 8 |
| 28 | 11100 | 11100 111 | 231 | 9 |
| 29 | 11101 | 11101 111 | 239 | 8 |
| 30 | 11110 | 11110 111 | 247 | 8 |
| 31 | 11111 | 11111 111 | 255 | 8 |

Table 4 provides a generalization of the nibble replication method and characterizes the color look-up table address distances.

TABLE 4

| | | |
|---|---|---|
| 12 bit db distance = | 17 for all cases | −16 colors |
| 15 bit db distance = | 8,8,8,9,8,8,8,9, . . . | −32 colors |
| 18 bit db distance = | 4,4,4,4,4,4,4,5,4,4,4,4,4,4,4,5, . . . | −64 colors |
| 21 bit db distance = | 2,2,2,2,2,2,2,2,2,2,2,2,2,2,2,3,2,2,2,2,2,2,2,2,2,2,2,2,2,2,2,3, . . . | −128 colors |
| 24 bit db = = | 1 for all cases | −256 colors |

Figure 12:
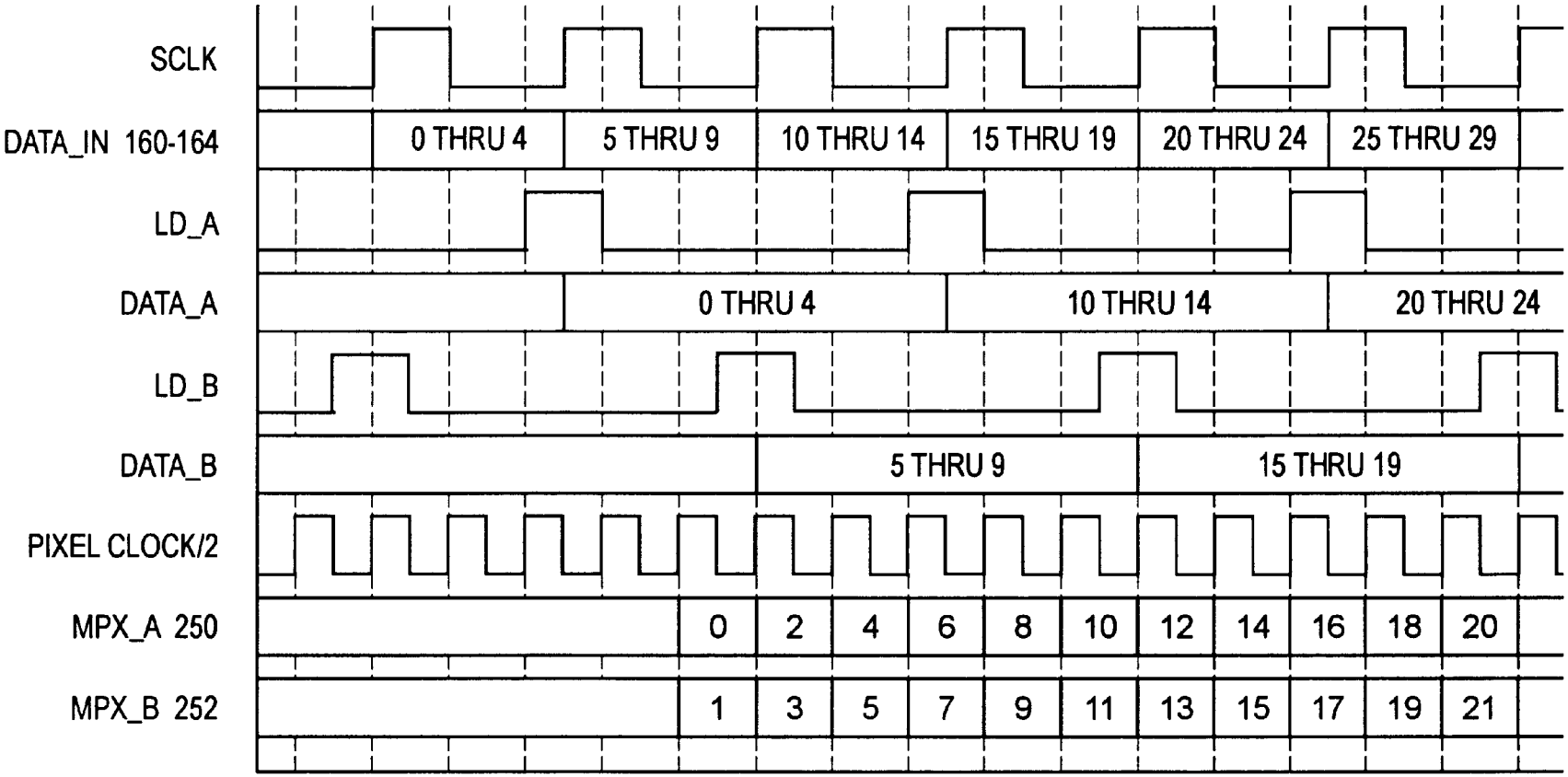
FIG. 12 is a timing diagram that illustrates the processing of the attribute data from the frame buffer interleaves by the frame buffer post processor, and shows the generation of the non overlapping serial enable signals by the frame buffer post processor.
Figure 13:
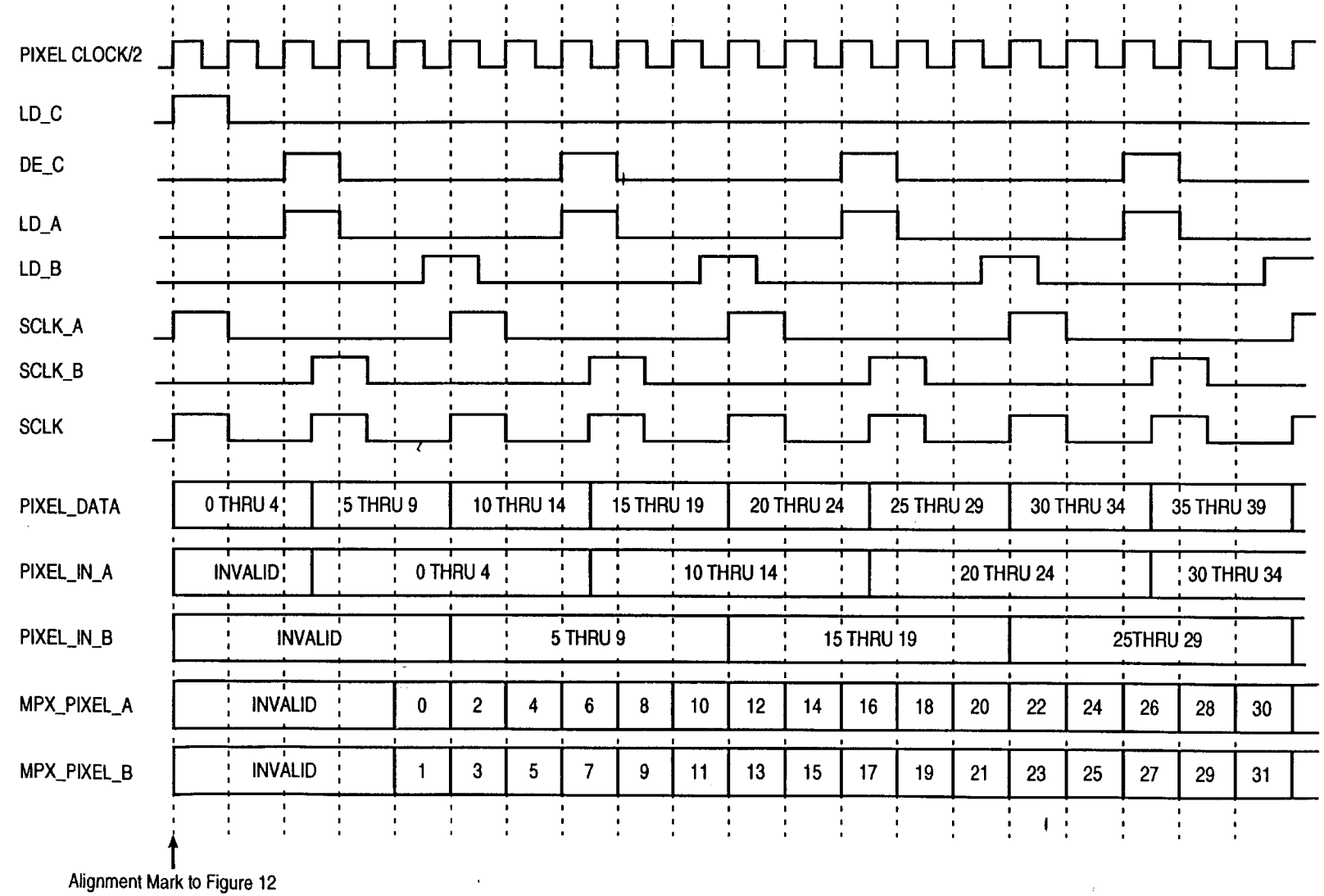
FIG. 13 is a timing diagram that illustrates the variable interleave between a 5 way horizontal interleave on the pixel bus and a 2 way interleave on the video bus.

FIG. 12 is a timing diagram that illustrates the processing of the data in the variable interleave circuit 150 for the preferred embodiment of a 5-to-2 interleave as shown in FIG. 8.

The image shift clock 130, shown as SCLK, clocks 5 way interleave data 160–164 comprising pixel data values on image busses 100–104 and corresponding attribute data on an attribute data busses 200–204, shown as DATA_IN 160–164, to registers 260, 262, 264, and 266. SCLK has a rate of the pixel clock divided by 5.

Control signals LD_A and LD_B on control bus 210 control the loading of registers 260, 262, 264, and 266. LD_A controls registers 262 and 266 which hold a first five attribute data and corresponding pixels. LD_B controls registers 260 and 264 which hold a second five attribute data and corresponding pixels. The data appearing on the lines connecting the registers 260, 262, 264, and 266 to multiplexers 270, 272, 274, and 276 are shown as DATA_A and DATA_B. DATA_A represents the attribute data on the outputs of register 262 and corresponding pixels on register 266. DATA_B represents the attribute data on the outputs of register 260 and corresponding pixels on register 264. LD_A and LD_B have a rate of the pixel clock divided by 10.

2 way interleave data 250 comprising image bus 230 and attribute bus 232 is shown as MPX_A and 2 way interleave data 252 comprising image bus 240 and attribute bus 242 is shown as MPX_B. MPX_A comprises data for even numbered pixels and MPX_B comprises data for odd numbered pixels. 2 way interleave data 250 and 252 is clocked at a rate of the pixel clock divided by 2, which is shown as PIXEL CLOCK/2.

In the foregoing specification the invention has been described with reference to specific exemplary embodiments thereof it will, however, be evident that various modifications and changes may be made thereto without departing from the broader spirit and scope of the invention as set forth in the appended claims. The specification and drawings are accordingly to be regarded as illustrative rather than restrictive.

What is claimed is:

1. A method for reading digital pixel data values from one of a plurality of frame buffers, comprising the steps of:

sending a first shift clock signal to a serial access memory portion of an attribute buffer;

reading attribute data associated with a video display location;

sending a second shift clock signal to the plurality of frame buffers;

sending a select enable signal to enable an output driver for one of the plurality of frame buffers according to the attribute data in the frame buffer; and reading a digital pixel data value associated with the video display location from the enabled one of the plurality of frame buffers.

2. The method of claim 1 wherein the plurality of frame buffers comprises a first buffer, a second buffer, and an overlay buffer.

3. A graphic subsystem comprising:

an attribute buffer comprising a plurality of attribute data values, each attribute data value uniquely associated with a video display location, and each attribute data value comprising a buffer select value;

a plurality of frame buffers, each frame buffer comprising a plurality of digital pixel data values, each digital pixel value uniquely associated with a video display location;

a frame buffer post processor operatively connected to the attribute buffer by an attribute bus and a first shift clock signal whereby the frame buffer post processor can sequentially read attribute data values;

the frame buffer post processor operatively connected to the plurality of frame buffers by an image bus, a second clock signal, and a plurality of serial enable signals with one serial enable signal connected to each frame buffer whereby the frame buffer post processor can sequentially read digital pixel values associated with a video display location by enabling one of the plurality of frame buffers according to the attribute data in the frame buffer and then transmitting the second clock signal.

4. The graphic subsystem of claim 3 wherein the plurality of frame buffers comprises a first buffer, a second buffer, and an overlay buffer.

5. A method for coupling a pixel bus which transmits data for x pixels in parallel at a pixel bus rate of f/x to a video bus which transmits data for y pixels in parallel at a video bus rate of f/y, comprising the steps of:

receiving and buffering y sets of x pixel data values received over the pixel bus at a rate of f/x; and selecting 1 of x inputs with each of y multiplexers to select y of the pixel data values for transfer over the video bus at a rate of f/y.

6. The method of claim 5 wherein x is 5 and y is 2.

7. The method of claim 6 wherein the steps of receiving and buffering two sets of 5 pixel data values and selecting 2 of the pixel data values are carried out by receiving and buffering a first set of 5 pixel values comprising a first, second, third, fourth, and fifth pixel value and then repeating the following steps, in the following order, until all the pixel values are received:

selecting the first and second pixel values;

receiving and buffering a second set of 5 pixel values comprising a sixth, seventh, eighth, ninth, and tenth pixel value;

selecting the third and fourth pixel values;

selecting the fifth and sixth pixel values;

selecting the seventh and eighth pixel values;

receiving and buffering a first set of 5 pixel values comprising a first, second, third, fourth, and fifth pixel value; and selecting the ninth and tenth pixel value.

8. An apparatus for coupling a pixel bus which transmits data for x pixels in parallel at a pixel bus rate of f/x to a video bus which transmits data for y pixels in parallel at a video bus rate of f/y, comprising:

y input registers, each input register comprising storage for x pixel data values;

y multiplexers, each multiplexer comprising x inputs for pixel data values, each multiplexer input operatively connected to one of the y input registers such that the first input of the first multiplexer is connected to the first output of the first input register, the first input of the second multiplexer is connected to the second output of the first input register, and so on through the xth input of the yth multiplexer which is connected to the xth output of the yth input register;

y control signals with a rate of f/(xy), each control signal operatively connected to one of the y input registers, with the y control signals arranged to successively load one of the y registers at f/x intervals; and a multiplexer select signal operatively connected to the y multiplexers arranged in parallel to successively select one of the x input values of each of the y multiplexers at f/y intervals.

9. The apparatus of claim 8 further comprising y output registers with each output register operatively connected to the output of one of the y multiplexers and a output control signal operatively connected to each of the y output registers in parallel to load and hold the output of the connected multiplexer at f/y intervals.

10. The apparatus of claim 8 wherein x is 5 and y is 2.

11. The apparatus of claim 10 wherein the first input of the first multiplexer is connected to the first output of the first input register, the first input of the second multiplexer is connected to the second output of the first input register, the second input of the first multiplexer is connected to the third output of the first input register, the second input of the second multiplexer is connected to the fourth output of the first input register, the third input of the first multiplexer is connected to the fifth output of the first input register, the third input of the second multiplexer is connected to the first output of the second input register, the fourth input of the first multiplexer is connected to the second output of the second input register, the fourth input of the second multiplexer is connected to the third output of the second input register, the fifth input of the first multiplexer is connected to the fourth output of the second register, and the fifth input of the second multiplexer is connected to the fifth output of the second input register.

12. A method for expanding an m bit value representing a color intensity of a primary video color to a larger n bit value comprising the steps of:

receiving the m bit value;

concatenating a sufficient number of replications of the m bit value to create an x bit value where x is less than or equal to n;

if x is less than n, concatenating the high order n−x bits of the m bit value to the lower order end of the x bit value to form the larger n bit value; and presenting the n bit value.

13. The method of claim 12 wherein m is 4, n is 8, and x is 8.

14. The method of claim 12 further comprising the steps of receiving the m bit value from an image buffer and using the n bit value as an address to retrieve a value from a color lookup table.

15. An apparatus for expanding an m bit value representing a color intensity of a primary video color to a larger n bit value comprising:

an m bit register for receiving and holding the m bit value; and an n bit data receiving means operatively connected to the m bit register such that the bits of the m bit register are connected to the m high order bits of the n bit data receiving means, and directly to the lower order bits of the n bit data receiving means until all n bits are connected.

16. The apparatus of claim 15 wherein the data receiving means is a register.

17. The apparatus of claim 15 wherein m is 4 and n is 8.

18. The apparatus of claim 17 wherein the 8 bit data receiving means is eight 2-to-1 single bit multiplexers and further comprising:

a second 4 bit register for receiving and holding a second 4 bit value in parallel with the first 4 bit value;

the eight 2-to-1 single bit multiplexers arranged as two groups of four with the first selected inputs of each group operatively connected to the 4 outputs of the first 4 bit register and the second selected inputs of each group operatively connected to the 4 outputs of the second 4 bit register; and control signals operatively connected to the two groups of single bit multiplexers to allow an 8 bit output value to be formed from one of the group composed of the first 4 bit register replicated, the second 4 bit register replicated, and the first 4 bit register concatenated with the second 4 bit register.

* * * * *